US005533565A

United States Patent [19]

Kodaira et al.

[11] Patent Number: 5,533,565

[45] Date of Patent: Jul. 9, 1996

[54] MOLD OSCILLATION DEVICE CAPABLE OF AUTOMATICALLY ADJUSTING AN OSCILLATION OF A MOLD USED IN A CONTINUOUS CASTING MACHINE

[75] Inventors: Kazuho Kodaira, Kanagawa; Yasuhito Itoh; Tetsuya Watanabe, both of Ehime, all of Japan

[73] Assignee: Sumitomo Heavy Industries, Ltd., Tokyo, Japan

[21] Appl. No.: 377,244

[22] Filed: Jan. 24, 1995

[30] Foreign Application Priority Data

Feb. 4, 1994 [JP] Japan ..... 6-012349

[51] Int. Cl.[6] ..... B22D 11/04; B22D 46/00; B22D 11/16; B22C 19/04

[52] U.S. Cl. ..... 164/416; 164/478; 164/451; 164/150.1; 164/154.1

[58] Field of Search ..... 164/416, 478, 164/451, 150.1, 154.1

[56] References Cited

U.S. PATENT DOCUMENTS 5,350,005 9/1994 Sorimachi et al. ..... 164/416

FOREIGN PATENT DOCUMENTS 62-34654 2/1987 Japan ..... 164/416

*Primary Examiner*—Jack W. Lavinder
*Assistant Examiner*—I.-H. Lin
*Attorney, Agent, or Firm*—Burns, Doane, Swecker & Mathis

[57] ABSTRACT

In a mold oscillation device for making oscillation of a mold used in a continuous casting machine, an acceleration sensor (22) detects the oscillation to produce an oscillation detection signal representative of said oscillation. The oscillation detection signal has a particular waveform. Responsive to the oscillation detection signal, a signal producing circuit (30) produces an adjusting signal with reference to the particular waveform. With reference to the adjusting signal, a control unit (16) controls the oscillation. In order to produce the adjusting signal, it is preferable that the signal producing circuit carries out a frequency analysis as regards the particular waveform.

10 Claims, 5 Drawing Sheets

MOLD OSCILLATION DEVICE CAPABLE OF AUTOMATICALLY ADJUSTING AN OSCILLATION OF A MOLD USED IN A CONTINUOUS CASTING MACHINE

BACKGROUND OF THE INVENTION

This invention relates to a mold oscillation device for making oscillation of a mold used in a continuous casting machine known in the art.

In order to stabilize a casting operation in such a continuous casting machine, it is necessary to avoid burning between the mold and a casting piece placed in the mold. In order to avoid the burning, it is effective to oscillate the mold during the casting operation. Under the circumstances, the continuous casting machine is provided with a mold oscillation device making oscillation of the mold.

In the manner which will presently be described, a conventional mold oscillation device comprises a driving apparatus, an oscillation detecting apparatus, and a control apparatus. The driving apparatus is connected to the mold and is for driving the mold to have the oscillation. The oscillation detecting apparatus is operatively connected to the mold and is for detecting the oscillation to produce an oscillation detection signal representative of the oscillation. The control apparatus is connected to the driving apparatus and the oscillation detecting apparatus and is responsive to the oscillation detection signal for controlling the oscillation detecting apparatus to have an operation which will later be described in detail with reference to the drawing.

In the conventional mold oscillation device, it is assumed that the control apparatus has a stability which is decreased under influence of aged deterioration in the driving apparatus. In this event, the mold has an abnormal oscillation. Under the circumstances, it is necessary for an operator to periodically adjust the control apparatus to have parameters which are suitable for controlling the oscillation detecting apparatus.

In addition, it is assumed that the abnormal oscillation occurs from another cause which is not the aged deterioration in the driving apparatus. In this event, the operator must at first find a situation of the oscillation and then adjust those parameters of the control apparatus by trial and error.

Accordingly, a considerably long time is consumed for periodical maintenance and recovery upon occurrence of the abnormal oscillation. In addition, the operator must have a professional knowledge.

SUMMARY OF THE INVENTION

It is therefore an object of this invention to provide a mold oscillation device which is capable of automatically adjusting an oscillation of a mold.

It is another object of this invention to provide a mold oscillation device of the type described, in which it is unnecessary to adjust the control apparatus even if the abnormal oscillation occurs in the mold.

According to an aspect of this invention, there is provided a mold oscillation device for making oscillation of a mold used in a continuous casting machine. The mold oscillation device comprises oscillation detecting means operatively coupled to the mold for detecting the oscillation to produce an oscillation detection signal representative of the oscillation. The oscillation detection signal has a particular waveform. The mold oscillation device further comprises signal producing means connected to the oscillation detecting means and responsive to the oscillation detection signal for producing an adjusting signal with reference to the particular waveform, and control means connected to the mold and the signal producing means for controlling the oscillation with reference to the adjusting signal.

According to another aspect of this invention, there is provided a mold oscillation device for a continuous casting apparatus, including an oscillation driving arrangement for driving an oscillation of a mold, and a feedback control system which includes an acceleration sensor for detecting an acceleration accompanying the oscillation of the mold to produce an acceleration detection signal and a position sensor for detecting a position of a driving portion in the oscillation driving arrangement to produce a position detection signal and which is for feeding, as a detection feedback signal, at least one of the acceleration detection signal and the position detection signal back to a control unit of the oscillation driving arrangement to thereby control the oscillation of the mold. The mold oscillation device comprises an abnormal oscillation judging portion supplied with the detection feedback signal for judging presence or absence of an abnormal oscillation of the mold through a frequency analysis of the detection feedback signal to produce a judgment result signal corresponding to a judgment result and an adjustment level producing portion responsive to the judgment result signal from the abnormal-oscillation judging portion for designating a feedback gain of a feedback gain setting part contained in the feedback control system.

DESCRIPTION OF THE PREFERRED EMBODIMENT

Figure 1:
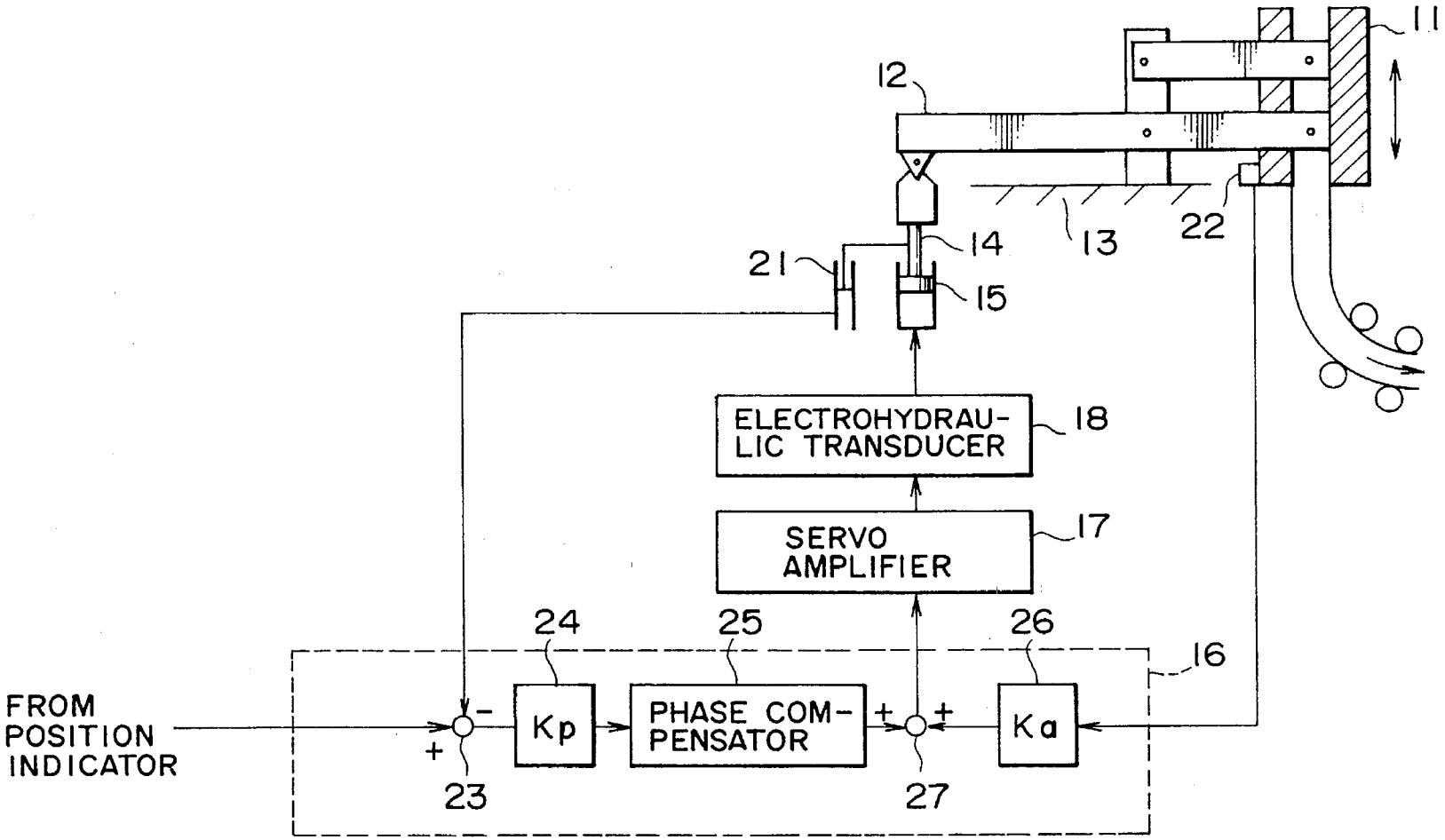
FIG. 1 PRIOR ART
FIG. 1 shows, together with a mold used in a continuous casting machine, a schematic diagram of a conventional mold oscillation device.

Referring to FIG. 1, a conventional mold oscillation device will be described at first for a better understanding of the present invention. The conventional mold oscillation device is for making oscillation of a mold 11 which is used in continuous casting machine for carrying out a casting operation. On carrying out the casting operation, the mold 11 is poured with molten metal in the manner known in the art. During the casting operation, burning is avoided between the mold 11 and the molten metal or a casting piece placed in the mold 11. This is because the mold 11 is oscillated by the conventional mold oscillation device.

In FIG. 1, the mold 11 is attached to one end of a drive beam 12 supported by a pedestal 13 to be able to perform "see-saw" movement. The other end of the drive beam 12 is pivotally supported by a top end of a displacement rod 14 of a hydraulic mechanism 15. A combination of the drive beam 12, the displacement rod 14, and the hydraulic mechanism 15 serves as a driving apparatus for driving the mold 11 to have the oscillation in a vertical direction indicated by an arrow.

The hydraulic mechanism 15 is supplied with a position instruction from a control unit 16 through a servo amplifier 17 and an electrohydraulic transducer 18. The hydraulic mechanism 15 provides a displacement of the displacement rod 14 in response to the position instruction. Following the displacement of the displacement rod 14, the drive beam 12 is given with an oscillation having a predetermined displacement or amplitude and, in turn, drives the oscillation of the mold 11.

The conventional mold oscillation device further comprises a position sensor 21 and an acceleration sensor 22 which is referred to as an oscillation detecting arrangement. The position sensor 21 is connected to the displacement rod 14 and is for detecting the displacement of the displacement rod 14 to produce a position detection signal representative of a detected position of the displacement rod 14. The acceleration sensor 22 is operatively connected to the mold 11 and is for detecting an acceleration accompanying the oscillation of the mold 11 to produce an acceleration detection signal representative of the acceleration. In other words, the acceleration sensor 22 detects the oscillation to produce, as the acceleration detection signal, an oscillation detection signal representative of the oscillation of the mold 11.

In the manner which will presently be described, the control unit 16 comprises a subtracter 23, a proportional gain setting part 24, a phase compensator 25, a feedback gain setting part 26, and an adder 27. The subtracter 23 is connected to the position sensor 21 and is supplied with the position detection signal and a position instruction signal which is produced in a position indicator (not shown) for indicating a predetermined position. Responsive to the position detection signal and the position instruction signal, the subtracter 23 subtracts the detected position from the predetermined position to produce a subtracter output signal. The proportional gain setting part 24 is connected to the subtracter 23 and is for setting a proportional gain Kp in accordance with the subtracter output signal to produce a proportional gain signal representative of the proportional gain Kp. The phase compensator 25 is connected to the proportional gain setting part 24 and is responsive to the proportional gain signal for producing a phase compensated signal which is used in stabilizing a whole control system in the control unit 16 in the manner known in the art. The feedback gain setting part 26 is connected to the acceleration sensor 22 and is for setting an acceleration feedback gain Ka in accordance with a control unit input signal to produce an acceleration feedback gain signal representative of the acceleration feedback gain Ka. In the conventional mold oscillation device, it is to be noted that the acceleration detection signal is used as the unit input signal. The adder 27 is connected to the phase compensator 25 and the feedback gain setting part 26 and for calculating a sum of the phase compensated signal and the acceleration feedback gain signal to produce a sum signal representative of the sum. The sum signal carries the above-mentioned position instruction that is supplied to the hydraulic mechanism 15 through the servo amplifier 17 and the electrohydraulic transducer 18.

In other words, the conventional mold oscillation device has a position feedback control system for feeding the position detection signal from the position sensor 21 back to the control unit 16 and for controllably driving the oscillation in response to the position instruction signal. The position feedback control system is also supplied with the acceleration detection signal from the acceleration sensor 22.

In the conventional mold oscillation device, the position feedback control system has stability decreased under influence of aged deterioration in the electrohydraulic transducer 18 and in a mechanical system of the driving apparatus. It is therefore essential for an operator to periodically adjust control parameters such as the proportional gain Kp and the acceleration feedback gain Ka. Upon occurrence of an abnormal oscillation, the operator must at first find a situation of the abnormal oscillation and then adjust those control parameters by trial and error. Accordingly, a considerably long time is consumed for periodical maintenance and recovery upon occurrence of the abnormal condition. In addition, the operator must have a professional knowledge.

Figure 2:
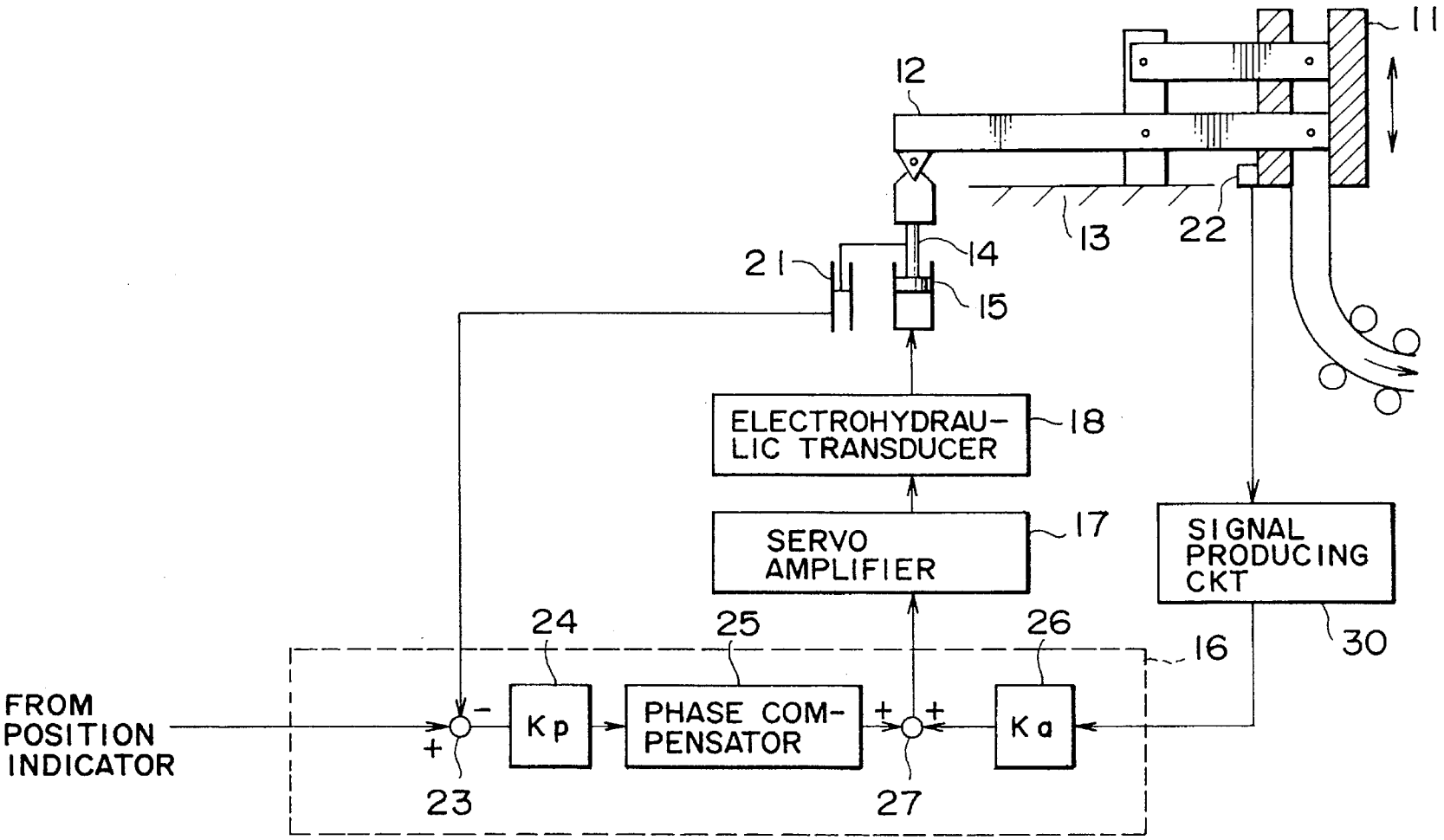
FIG. 2 shows, together with a mold used in a continuous casting machine, a schematic diagram of a mold oscillation device according to an embodiment of this invention.

Referring to FIG. 2, the description will be made as regards a mold oscillation device according to an embodiment of this invention. The mold oscillation device comprises similar parts designated by like reference numerals. In the mold oscillation device, the oscillation of the mold 11 has an oscillation frequency and oscillation intensity. The oscillation frequency is selectively determined within a frequency range of 0–10 Hz. The oscillation intensity varies between a lowest and a greatest one in relation to the oscillation frequency.

The mold oscillation device further comprises a signal producing circuit 30 connected between the acceleration sensor 22 and the feedback gain setting part 26. Responsive to the acceleration detection signal, the signal producing circuit 30 produces, as the control unit input signal, an adjusting signal in the manner which will later be described in detail. In accordance with the adjusting signal, the feedback gain setting part 26 sets the acceleration feedback gain Ka to produce the acceleration feedback gain signal. The feedback gain setting part 26 will be referred to as an adjusting arrangement. It will be assumed that the acceleration detection signal has a particular waveform corresponding to one of various waveform patterns in the manner which will later be described in detail.

Figure 3:
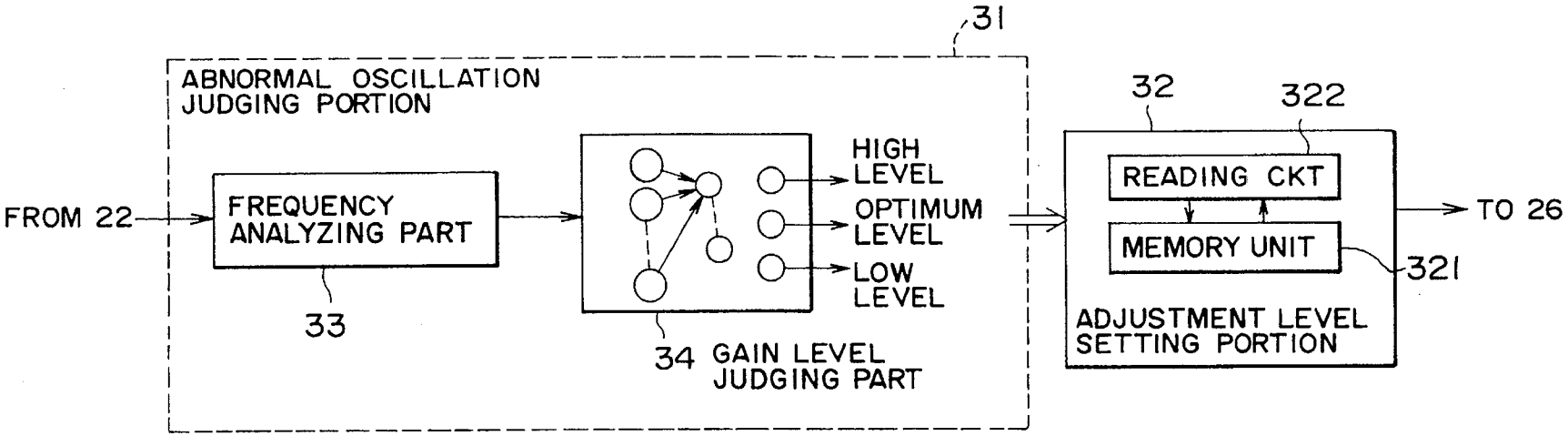
FIG. 3 is a block diagram of a signal producing circuit included in the mold oscillation device of FIG. 2.

Turning to FIG. 3 in addition to FIG. 2, the signal producing circuit 30 will be described in detail. In the manner which will presently be described, the signal producing circuit 30 comprises an abnormal judging portion 31 and an adjustment level setting portion 32. The abnormal judging portion 31 is connected to the acceleration sensor 22 and is responsive to the acceleration detection signal for judging with reference to the particular waveform whether or not the oscillation is abnormal. When the oscillation is abnormal, the abnormal judging portion 31 produces an abnormal signal. Otherwise, the abnormal judging portion 31 produces a normal signal. More particularly, the abnormal judging portion 31 is for carrying out inspection of the oscillation with reference to the particular waveform to produce one of the abnormal and the normal signals that will collectively be called an inspection result signal. The abnormal judging portion 31 will be referred to as an inspecting arrangement.

The abnormal judging portion 31 comprises a frequency analyzing part 33 and a gain level judging part 34 composed of a neural network. The frequency analyzing part 33 is connected to the oscillation sensor 22 and is for carrying out a frequency analysis as regards the particular waveform of the oscillation detection signal in the manner which will later be described. The frequency analyzing part 33 produces an analysis result signal representative of a result of the frequency analysis.

More particularly, the frequency analyzing part 33 is supplied with the acceleration detection signal and carries out a normalization as regards the oscillation intensity with reference to the acceleration detection signal to produce the analysis result signal as follows. At first, the frequency analyzing part 33 determines, as a reference value, the greatest one of-the oscillation intensity. After that, the frequency analyzing part 33 divides a current one of the oscillation intensity by the reference value to produce a normalized signal as the analysis result signal.

The frequency analyzing part 33 may be implemented by a frequency analyzer known in the art. Alternatively, the frequency analyzing part 33 may be implemented by a structure in which the acceleration detection signal is taken in a computer for carrying out a fast Fourier transform (FFT) analysis known in the art.

The gain level judging part 34 is connected to the frequency analyzing part 33 and the adjustment level setting portion 32 and is for judging in accordance with the analysis result signal about whether or not the acceleration feedback gain Ka has a gain level higher than an optimum level which will later become clear. When the gain level is equal to the optimum level, the gain level judging part 34 produces the normal signal. When the gain level is lower than the optimum level, the gain level judging part 34 produces a low level signal as the abnormal signal. When the gain level is higher than the optimum level, the gain level judging part 34 produces a high level signal as the abnormal signal. Herein, the gain level judging part 34 will be referred to as a judging arrangement and may be composed of a neural network known in the art.

More particularly, the gain level judging part 34 is supplied with the normalized signal, which is obtained by the frequency analysis in the frequency analyzing part 33 as described above, and judges whether the acceleration feedback gain Ka has an optimum level, a high level higher than the optimum level, or a low level lower than the optimum level. The gain level judging part 34 is composed of a hierarchical neural network. As known in the art, operation is different between the learning process and the executing process.

The adjustment level setting portion 32 is connected to the gain level judging part 34 and the feedback gain setting part 26 for producing the adjusting signal in response to the inspection result signal. In other words, the adjustment level setting portion 32 designates the acceleration feedback gain Ka to the feedback gain setting part 26 in response to the inspection result signal. The adjustment level setting portion 32 will be referred to as a local producing arrangement.

Returning back to FIG. 2, the description will proceed. Responsive to the position instruction signal, the control unit 16 makes the oscillation of the mold 11 so that the mold 11 has an oscillation pattern comprising a sine wave of a fundamental frequency or a synthesized wave of the sine wave and a harmonic wave superposed thereon. Accordingly, the acceleration signal includes a frequency component of the fundamental wave and the harmonic wave. The frequency component will be called hereinunder a base frequency component.

When the oscillation is abnormal, the acceleration signal includes an abnormal frequency component in addition to the base frequency component. It has been experimentally confirmed that the abnormal frequency component has a frequency which is different between the instances where the acceleration feedback gain Ka is too high and too low.

Figure 4A:
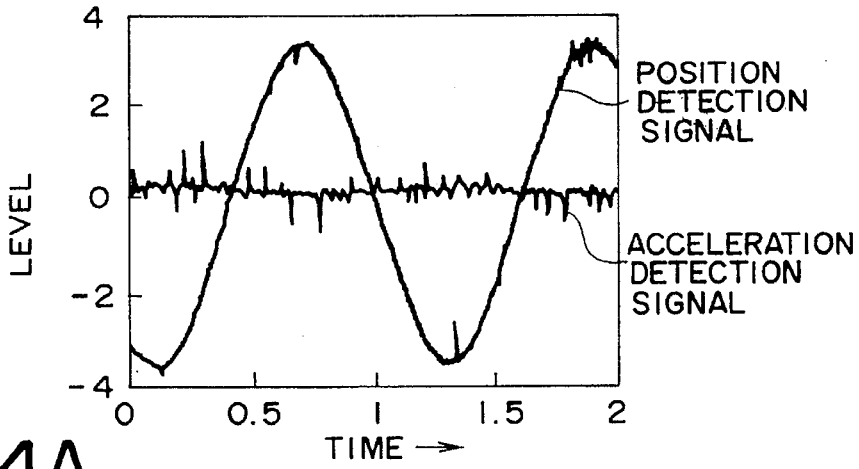
FIGS. 4A–4C are waveform charts each of which represents an acceleration detection signal and a position detection signal.
Figure 4B:
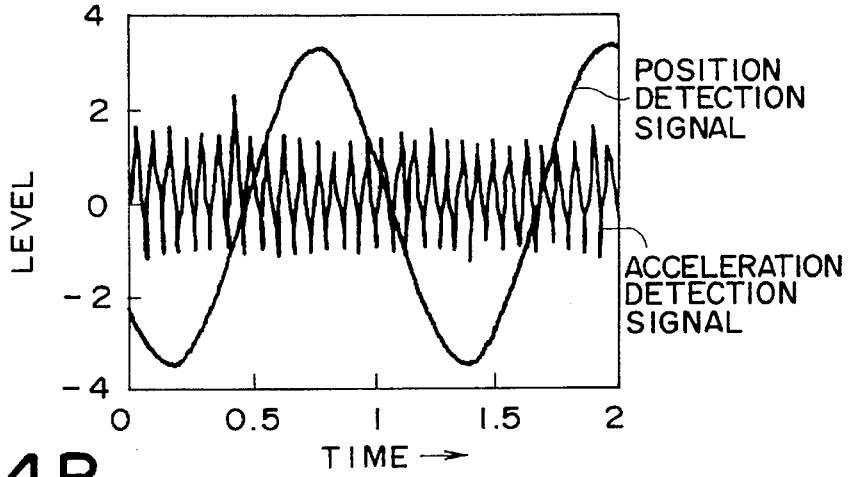
Figure 4C:
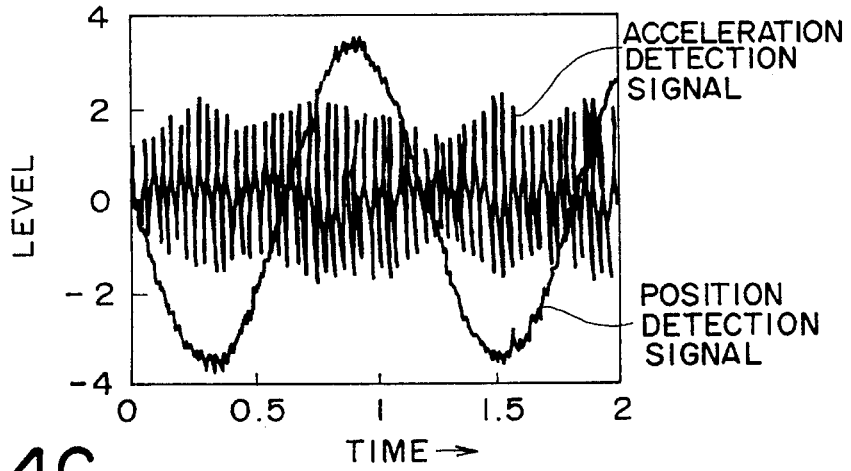

Turning to FIGS. 4A–4C, the description will be directed to the above-mentioned waveform patterns. A first one of the waveform patterns is illustrated in FIG. 4A and represents a first case where the gain level of the acceleration feedback gain Kp is equal to the optimum level. A second one of the waveform patterns is illustrated in FIG. 4B and represents a second case where the gain level is lower than the predetermined level. A third one of the waveform patterns is illustrated in FIG. 4C and represents a third case where the gain level is higher than the predetermined level.

Figure 5A:
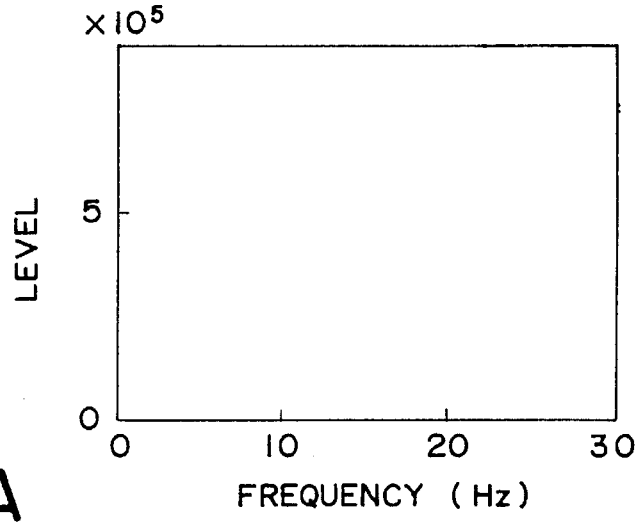
FIGS. 5A–5C are graph for use in describing an operation of a frequency analyzing part included in the signal producing circuit of FIG. 3.
Figure 5B:
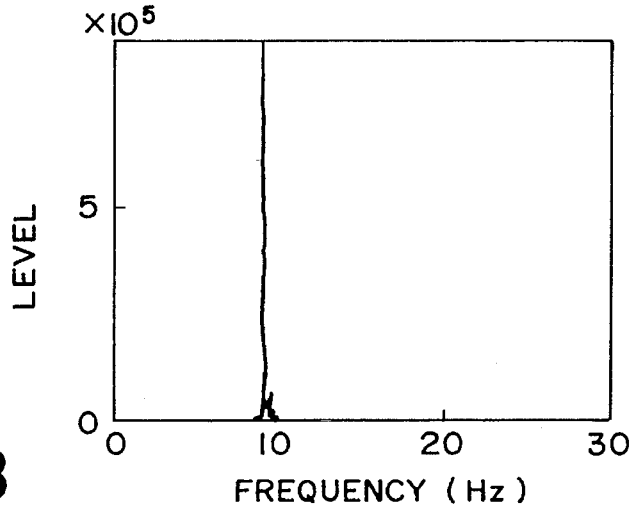
Figure 5C:
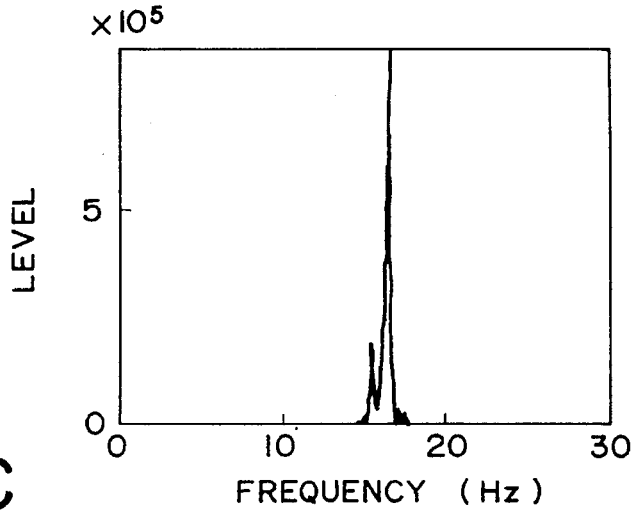

Turning to FIGS. 5A–5C together with FIG. 3, the description will be directed to operation of the frequency analyzing part 33. In the first case, a frequency component does not occur substantially on the acceleration detection signal. Therefore, the frequency analyzing part 33 produces the analysis result signal that is representative of the result of the frequency analysis as illustrated in FIG. 5A. In the second case, the acceleration detection signal has a relatively low frequency. Therefore, the frequency analyzing part 33 produces the analysis result signal that is representative of the result of the frequency analysis as illustrated in FIG. 5B. In the third case, the acceleration detection signal has a relatively high frequency. Therefore, the frequency analyzing part 33 produces the analysis result signal that is representative of the result of the frequency analysis as illustrated in FIG. 5C.

Returning back to FIG. 3, the description will proceed. The abnormal oscillation judging portion 31 carries out judgment of the abnormal oscillation by the use of the gain level judging part 34 implemented by the neural network. During factory adjustment of the driving arrangement, collection is carried out of those data each including the acceleration detection signal from the acceleration sensor 22 in correspondence to the acceleration feedback gain Ka of the optimum level, the high level, and the low level, respectively. By the use of those collected data, the gain level judging part 34 is subjected to a learning process known in the art. Thus, an actual judgment of the abnormal oscillation is enabled.

Specifically, the learning process is carried out during the factory adjustment. The acceleration detection signals then collected are made to pass through the frequency analyzing part 33 to obtain the normalized signal. At this time, the relationship between the acceleration detection signals and the levels of the acceleration feedback gain Ka is preliminarily known. By the use of those data, the neural network is subjected to the learning process so as to produce a desired judgment result when the normalized signal is supplied. During the executing process on the other hand, the neural network having been subjected to the learning process as described above is utilized. Supplied with the normalized signal from the frequency analyzing part 33, the gain level judging part 34 judges whether the acceleration feedback gain Ka at that time instant has the optimum level, the high level, or the low level.

Next, description will be made as regards an operation of the adjustment level setting portion 32. The adjustment level setting portion 32 is supplied with an output of the abnormal oscillation judging portion 31, namely, the judgment result signal representative of whether the acceleration feedback gain Ka has the optimum level, the high level, or the low level, and delivers the designated level of the acceleration feedback gain Ka to the feedback gain setting part 26. For example, the adjustment level setting portion 32 comprises a memory unit 321 and a reading circuit 322. The memory unit 321 memorizes a table representative of a one-to-one relationship between a judgment result whether the acceleration feedback gain Ka has the optimum level, the high level, or the low level, and each of a plurality of adjustment levels. In other words, the memory unit 321 is for memorizing the adjustment levels and the waveform patterns in one-to-one correspondence to each other. The reading circuit 322 is connected to the memory unit 321, the gain level judging part 34, and the control unit 16 and is for reading a selected one of the adjustment levels from the memory unit 321 with reference to one of the waveform patterns to supply, as the adjusting signal, a signal representative of the selected adjustment level to the control unit 16.

Alternatively, the adjustment level setting portion 32 may be implemented by a computer for carrying out a predetermined calculation.

The feedback gain setting part 26 adjusts the acceleration feedback gain Ka to the designated level designated by the selected adjustment level. The abnormal oscillation judging portion 31 again takes in the acceleration detection signal from the acceleration sensor 22 and carries out judgment of the abnormal oscillation to judge presence or absence of the abnormal oscillation. The above-mentioned operation is repeated until the acceleration feedback gain Ka is judged to have the optimum level.

As described above, the abnormal oscillation judging portion 31 carries out the frequency analysis upon the acceleration detection signal. From the result of the frequency analysis, judgment is made of presence or absence of the abnormal oscillation. The result of judgment is produced as the judgment result signal in relation to the level of the acceleration feedback gain Ka. The adjustment level setting portion 32 is responsive to the judgment result signal and automatically adjusts the acceleration feedback gain Ka.

While the present invention has thus far been described in connection with a few embodiments thereof, it will readily be possible for those skilled in the art to put this invention into practice in various other manners. For example, one of the position detection signal and the sum signal may be used in place of the acceleration detection signal that is supplied to the frequency analyzing part 33. Adjustment may be made as regards the proportional gain Kp in the proportional gain setting part 24 or a parameter in the phase compensator 25. Furthermore, the gain level judging part 34 may be designed to produce four or more kinds of the judgment results.

What is claimed is:

1. A mold oscillation device for oscillating a mold used in a continuous casting machine, said mold oscillation device comprising:

oscillation detecting means operatively coupled to said mold for detecting oscillation to produce an oscillation detection signal having a waveform related to said oscillation;

signal producing means connected to said oscillation detecting means and responsive to said oscillation detection signal for judging said waveform and for selecting an adjustment level with reference to said waveform to produce an adjusting signal representative of said adjustment level; and control means connected to said mold and said signal producing means for controlling said oscillation with reference to said adjusting signal.

2. A mold oscillation device as claimed in claim 1, wherein said signal producing means comprises:

inspecting means connected to said oscillation detecting means and responsive to said oscillation detection signal for carrying out inspection of said oscillation with reference to said waveform to produce an inspection result signal representative of a result of said inspection; and local producing means connected to said inspecting means and said control means for selecting said adjustment level in response to said inspection result signal to produce said adjusting signal and to supply said adjusting signal to said control means.

3. A mold oscillation device as claimed in claim 2, wherein said control means controls said oscillation in accordance with a feedback gain, said control means comprising adjusting means connected to said local producing means for adjusting said feedback gain in response to said adjusting signal.

4. A mold oscillation device as claimed in claim 3, wherein said inspecting means comprises:

frequency analyzing means connected to said oscillation detecting means for carrying out a frequency analysis as regards said waveform of the oscillation detection signal to produce an analysis result signal representative of a result of said frequency analysis; and judging means connected to said frequency analyzing means and said local producing means and responsive to said analysis result signal for judging whether or not said feedback gain is abnormal, said judging means producing, as said inspection result signal, an abnormal signal when said feedback gain is abnormal, said judging means producing, as said inspection result signal, a normal signal when said feedback gain is normal.

5. A mold oscillation device as claimed in claim 4, wherein said waveform of the oscillation detection signal is one of a plurality of waveform patterns, said local producing means comprising:

a memory for memorizing said waveform patterns and adjustment levels in one-to-one correspondence with said waveform patterns; and reading means connected to said memory, said judging means, and said control means and responsive to said abnormal signal for reading one of said adjustment levels from said memory with reference to said one of the waveform patterns to supply, as said adjusting signal, a signal representative of said one of the adjustment levels to said control means.

6. A mold oscillation device as claimed in claim 1, said mold having a mold position dependent on said oscillation, wherein said mold oscillation device further comprises:

position detecting means operatively coupled to said mold for detecting said mold position to produce a position detection signal representative of said mold position, said control means being connected to said position detecting means for controlling said oscillation with reference to said position detection signal and said adjusting signal.

7. A mold oscillation device as claimed in claim 6, wherein said oscillation detecting means detects an acceleration of said oscillation to produce an acceleration signal as said oscillation detection signal that is supplied to said judging means.

8. A mold oscillation device for a continuous casting apparatus, including an oscillation driving arrangement for driving an oscillation of a mold, and a feedback control system which includes an acceleration sensor for detecting an acceleration accompanying said oscillation of said mold to produce an acceleration detection signal and a position sensor for detecting a position of a driving portion in said oscillation driving arrangement to produce a position detection signal and which is for feeding, as a detection feedback signal, at least one of said acceleration detection signal and said position detection signal back to a control unit of said oscillation driving arrangement to thereby control said oscillation of said mold, said mold oscillation device comprising:

an abnormal oscillation judging portion supplied with said detection feedback signal for judging presence or absence of an abnormal oscillation of said mold through a frequency analysis of said detection feedback signal to produce a judgment result signal corresponding to a judgment result; and an adjustment level producing portion responsive to said judgment result signal from said abnormal oscillation judging portion for designating a feedback gain of a feedback gain setting part of said feedback control system.

9. A mold oscillation device as claimed in claim 8, wherein said abnormal oscillation judging portion comprises:

a frequency analyzing part for frequency analyzing said feedback detection signal; and a gain level judging part which includes a neural network and which is responsive to a result of said frequency analysis and judges a level of said feedback gain in relation to said abnormal oscillation of said mold to produce a gain level indication signal indicative of said level of said feedback gain as said judgment result signal.

10. A mold oscillation device as claimed in claim 8, wherein said adjustment level producing portion comprises a memory unit which memorizes a table representative of a relationship between said judgment result signal and an adjustment level of said feedback gain.

* * * * *